US005535923A

United States Patent [19]

Fujioka

[11] Patent Number: 5,535,923

[45] Date of Patent: Jul. 16, 1996

[54] WASHING APPARATUS FOR BEVERAGE POURING APPARATUS

[75] Inventor: Akio Fujioka, Tokyo-to, Japan

[73] Assignee: Kirin Beer Kabushiki Kaisha, Tokyo-to, Japan

[21] Appl. No.: 295,796

[22] PCT Filed: Jan. 25, 1993

[86] PCT No.: PCT/JP93/00087

§ 371 Date: Sep. 15, 1994

§ 102(e) Date: Sep. 15, 1994

[87] PCT Pub. No.: WO94/16984

PCT Pub. Date: Aug. 4, 1994

[51] Int. Cl.[6] ..... B67D 1/08

[52] U.S. Cl. ..... 222/148; 137/212; 137/240; 222/400.7

[58] Field of Search ..... 222/146.6, 148, 222/400.7, 400.8; 137/15, 212, 240

[56] References Cited

U.S. PATENT DOCUMENTS

| | | | |
|---|---|---|---|
| 2,563,385 | 8/1951 | Warcup | 222/148 X |
| 3,945,536 | 3/1976 | Doak | 222/148 |
| 4,212,414 | 7/1980 | Beyens | 222/148 |
| 4,228,927 | 10/1980 | Beyens et al. | 222/400.7 X |
| 4,615,466 | 10/1986 | Credle, Jr. | 137/340 X |

FOREIGN PATENT DOCUMENTS

| | | | |
|---|---|---|---|
| 2659074 | 9/1991 | France | 222/148 |
| 254596 | 10/1989 | Japan | 222/400.7 |

*Primary Examiner*—Kevin P. Shaver
*Attorney, Agent, or Firm*—Oblon, Spivak, McClelland, Maier & Neustadt

[57] ABSTRACT

A washing apparatus for a beverage pouring apparatus is disclosed which includes a pouring valve for a dispensing head which is a three way valve. A discharging tube is connected to the three way valve, and a washing liquid is discharged into the discharging tube by changing the three way valve. A washing liquid circuit is formed by connecting a washing liquid return tube to the three way valve. A four way valve is connected to the washing liquid return tube, and the washing liquid can flow in both directions of the circuit by changing the four way valve.

4 Claims, 13 Drawing Sheets

WASHING APPARATUS FOR BEVERAGE POURING APPARATUS

TECHNICAL FIELD

This invention relates to a washing apparatus for a beverage pouring apparatus.

BACKGROUND ART

A conventional draught beer pouring apparatus is shown in FIG. 14. In FIG. 14, a reference numeral 110 shows a carbonic acid gas cylinder which is a gas container for pushing beer, a reference numeral 111 shows a beer keg in which draught beer is accommodated, and a reference numeral 112 shows a dispensing head.

Carbonic acid accommodated in the carbonic acid cylinder 110 passes through a pressure reducing valve 113 by which carbonic acid gas pressure is reduced to the most suitable pressure, and reaches a space 111*a* formed in the upper portion of the beer keg 111 via the conventional dispensing head 112.

Beer in the lower portion 111*b* of the beer keg 111 passes through the inner space of a pouring tube 112*a* of the dispensing head 112 and a connecting hose 114 to reach a dispenser 115. The dispenser 115 comprises a container 115*a* for ice, a cooling coil 115*b* for cooling beer passing through the interior thereof, and a pouring valve 115*c* for pouring beer into a beer cup (not shown). Beer passing through the dispenser 115 is cooled and poured into the beer cup.

If the dispensing head 112, the connecting hose 114 and the cooling coil 115*b* of the beer pouring apparatus are not periodically washed, microbe will increase to make the taste of beer pouring into the beer cup become worse and dirty.

Therefore, conventionally, whenever pouring of draught beer is finished, the washing is done as follows. Namely, the dispensing head 112 is taken away from the beer keg 111 to be installed to a washing tank 116 filled with water or medicine liquid as shown in FIG. 15. Water or liquid medicine is passed through the dispensing head 112, the connecting hose 114 and the cooling coil 115*b* by supplying carbonic acid to the washing tank 116 in the same manner as the time of pouring beer, and washing liquid used for washing the dispensing head 112, etc., is discharged to a container 117.

Thus, at the time of washing, it takes much time to take away the dispense head 112 from the beer keg and install to the washing tank, and such an operation is troublesome.

Further, in the method of washing as stated above, since the pouring valve 115*c* of the dispenser 115 is a two position valve thereby to scatter the washing liquid discharged from the pouring valve 115*c*, it is impossible to flow washing liquid at a high speed.

A cooling coil washing apparatus having a washing liquid circuit is disclosed in Japanese Utility Model Publication However, the conventional apparatus has a problem of a troublesome operation such that, when the washing is done, a soda drink supply tube is taken away to install the washing liquid circuit to the same place.

The present invention is made in view of the circumstances as stated above.

A first object of this invention is to provide an apparatus which can wash a beverage pouring circuit in a state wherein a dispensing head is installed at a beverage keg.

A second object of this invention is to provide an apparatus in which washing liquid can pass at a high speed and can improve washing effect by only switching a pouring valve.

A third object of this invention is to provide an apparatus which has a washing liquid circuit and can improve washing effect by changing flowing direction of washing liquid in both directions without exchanging the dispensing head.

DISCLOSURE OF INVENTION

A dispensing head of this invention comprises a housing having a washing liquid mouth at the upper portion of its side wall and a gas mouth at the lower portion thereof, a sliding body which is slidably installed inside of the housing in the vertical directions and which has a through hole extending in the axial direction of the sliding body and at least one connecting hole for connecting the through hole to the outer circumference of the sliding body, and a handle for sliding the sliding body. The dispensing head closes either the washing liquid mouth or the gas mouth by sliding the sliding body.

In the beverage pouring apparatus of this invention which pours soda drink accommodated in a container into a cup through a pouring valve under the pressure of carbonic acid supplied from a carbonic acid source, the pouring valve is a three way valve thereby to discharge washing liquid to a washing liquid discharge tube by changing the three way valve during washing. The washing liquid is supplied from a soda drink supply tube.

Further, in the beverage pouring apparatus of this invention which pours soda drink accommodated in the container into the cup from the pouring valve under the pressure of carbonic acid supplied from the carbonic acid source, a dispensing head is capable of changing supply of carbonic acid and washing liquid, the pouring valve is a three way valve, and a four way valve is installed at a washing liquid return tube connecting the pouring valve to the dispensing head. A washing liquid circuit is formed of the dispensing head, the pouring valve and the four way valve, and, by changing the four way valve, washing liquid can flow in both directions of the circuit.

BEST MODE FOR CARRYING OUT THE INVENTION

A dispensing head of this invention will be explained with reference to FIGS. 1 to 5.

Figure 1:
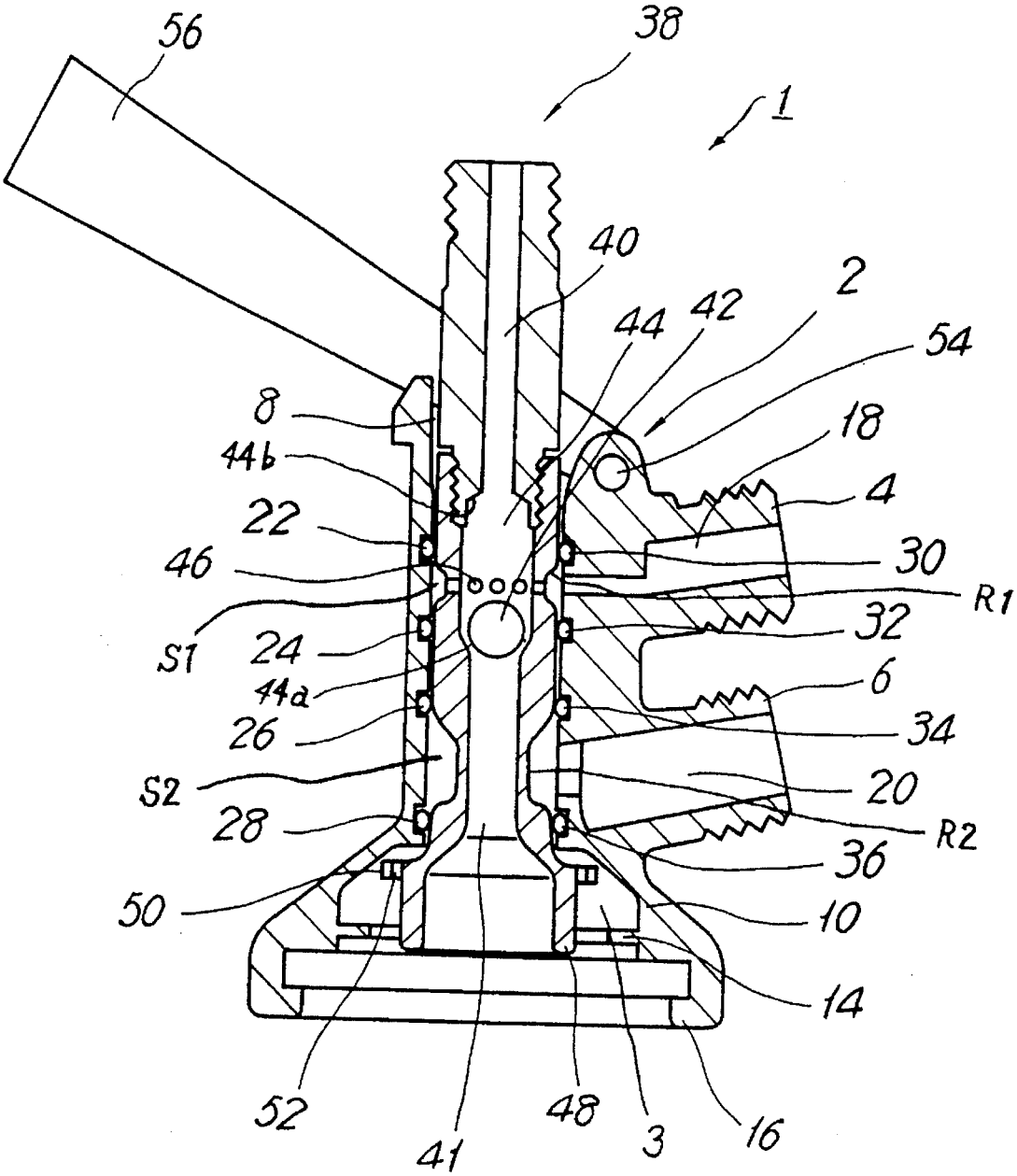
FIG. 1 is an elevational sectional view of a dispensing head of this invention during washing.
Figure 2:
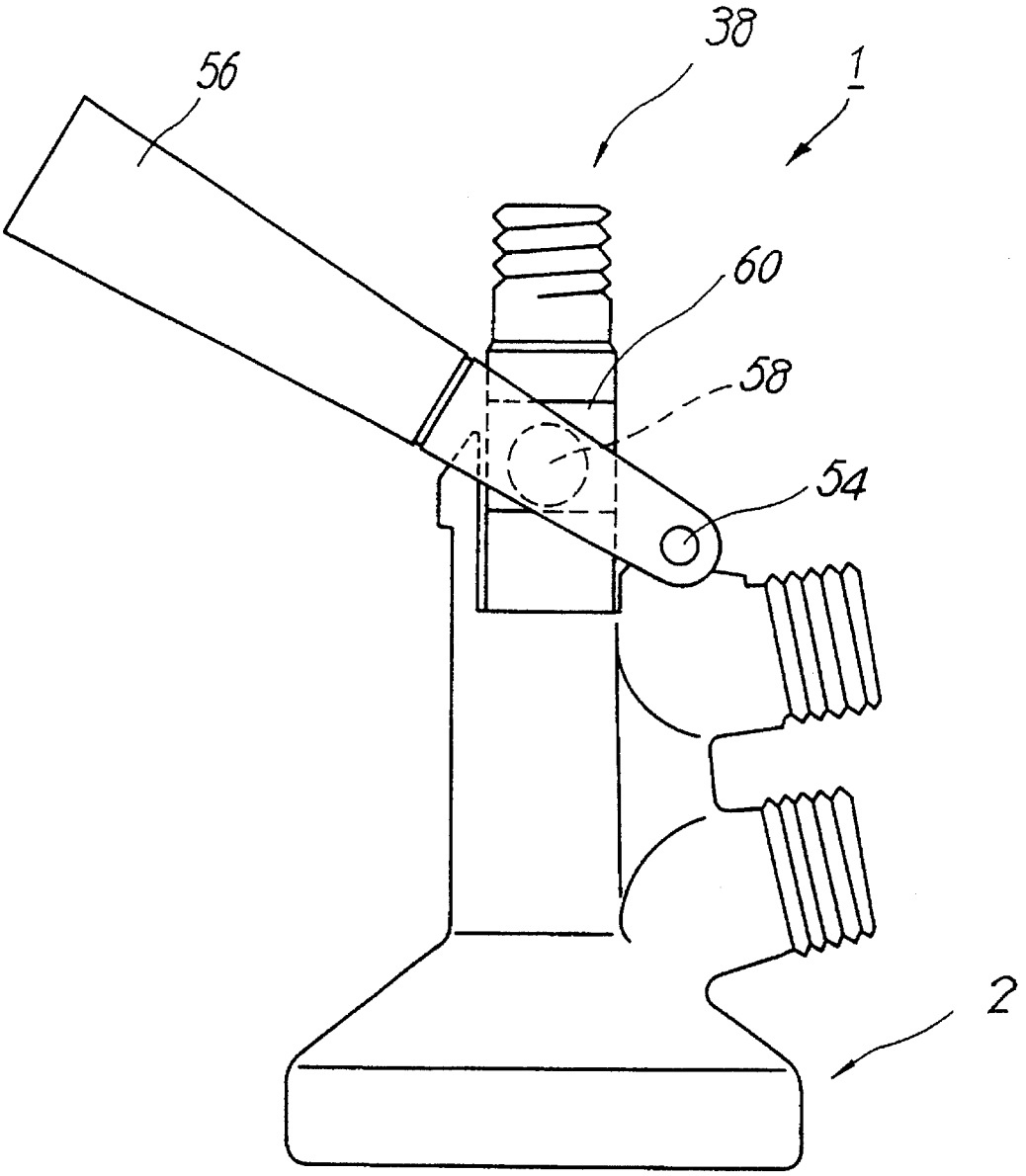
FIG. 2 is a front view of the dispensing head of this invention during washing.

FIG. 1 is a sectional view of a dispensing head 1 during washing, and FIG. 2 is an elevational view of the dispensing head 1. A reference numeral 2 shows a housing of the dispensing head. A washing liquid mouth 4 is formed at the upper portion of the side wall of the hosing 2, and a gas mouth 6 is formed at the lower portion of the housing 2. A side hole 8 is formed in the hosing 2 so as to slide a sliding body 38 in the vertical direction of the housing 2.

To the lower portion of the slide hole 8 is continuously formed a cone portion 10 which is gradually expanded outwardly. An enlarged space 3 is formed inside of the cone portion 10, and the bottom end portion of the cone portion 10 is opened to be connected to a pouring mouth of a keg.

Figure 3:
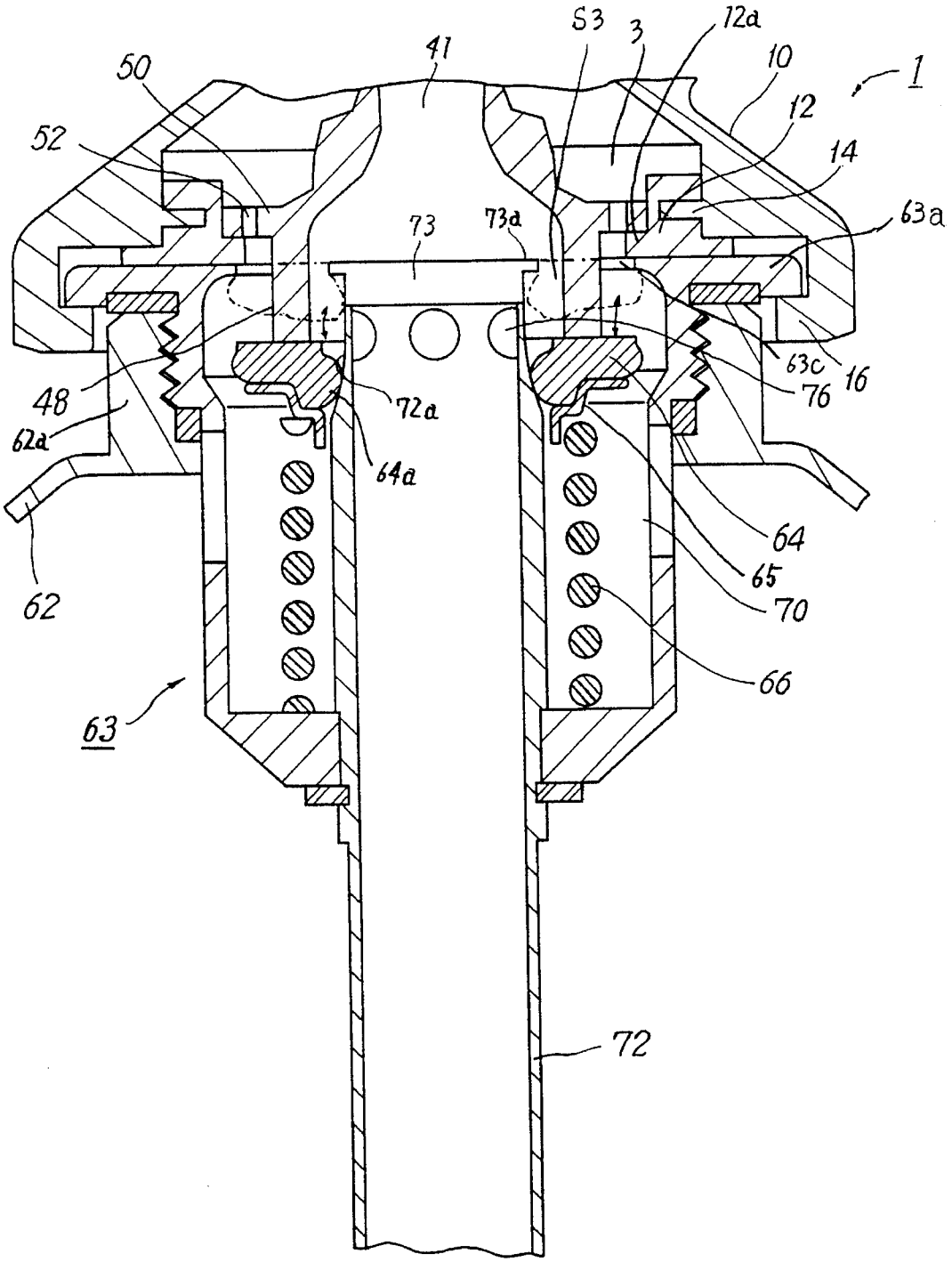
FIG. 3 is an enlarged cross sectional view of the keg install portion of the dispensing head at the time of pouring.

FIG. 3 is an enlarged view of the cone portion 10 when the cone portion 10 is connected to the keg. The cone portion 10 comprises an inner flange 14 for installing a packing 12 inside of the cone portion 10 and a projection 16 projecting in the inward direction thereof for connecting the housing 2 to the keg.

A ring-like seal portion 12*a* is formed at the packing 12 fixed to the inner flange 14. The seal portion 12*a* abuts against an outer flange 50 formed at the lower portion of the sliding body 38 at the time of beer pouring to prevent gas from leaking to the outside of the housing.

A spear valve 63 is screwed to a pouring mouth 62*a* of a beer keg 62, and a flange 63*a* is formed at the upper portion of the spear valve 63. The projection 16 is connected to the flange 63*a* so that the dispensing head 1 is detachably installed at the pouring mouth 62*a* of the beer keg.

The spear valve 63 is fixed to a discharging tube 72, and a plurality of connecting openings 70 for gas are formed at the circumferential wall of the spear valve 63.

A compressed coil spring 66 is installed inside of the spear valve 63, and a ring-like packing 64 is urged by the spring 66 in the upward direction to be maintained between the flange 63*a* and a maintaining plate 65.

The packing 64 slides in the upward and downward directions to open and close a ring-like space S3.

The lower face of the cylindrical contacting portion 48 formed at the lower end portion of the sliding body 38 pushes the packing 64 to slide it in the upward and downward directions. The space S3 is formed between a flange 73*a* of a cap 73 installed at the upper end portion of the discharging tube 72 and the inside wall 63*c* of the opening formed at the upper end portion of the spear valve 63.

The outer circumferential surface of the upper end portion of the discharging tube 72 is inclined, and the connecting portion 64*a* of the packing 64 contacts the inclining face 72*a* when the packing 64 goes down.

A plurality of through holes 76 are formed at the circumferential wall of the upper end portion of the discharging tube 72. The washing liquid mouth 4 and the gas mouth 6 are connected to the slide hole 8 via connecting holes 18 and 20. Ring-like cutting portions 30, 32, 34 and 36 are formed at the slide hole 8 to maintain O-rings 22, 24, 26 and 28, respectively.

The sliding body 38 has a through hole 40 formed in the center portion of the sliding body 38. The lower portion of the through hole is expanded to form an enlarged space 41.

A cylindrical space 44 in which a ball 42 is movably accommodated in the upward and downward directions is formed at the middle portion of the through hole 40. The space 44 and the ball 42 form a check valve. A valve seat 43*a* is formed at the lower portion of the space 44, and a valve seat 44*b* is formed at the upper portion of the space 44.

A plurality of connecting holes 46 for connecting the space 44 to the outside of the sliding body 38 are formed at the circumferential wall of the space 44. The portion where these connecting holes 46 are formed has a recessed part R1, and a space S1 is formed between the recessed part R1 and the inner wall of the slide hole 8. A recessed part R2 is formed below the portion where the space S1 is formed, and a space S2 is formed by the recessed part R2.

The contacting portion 48 is formed at the lower end portion of the sliding body 38 so as to project in the downward direction. Further, the outer circumferential surface of the contacting potion 48 has a shape of cylinder, and has a larger diameter than that of the center portion of the sliding body 38.

The outer flange 50 is formed at the upper portion of the outer circumference of the contacting portion 48. The outer flange 50 is engaged with the packing 12 (see FIG. 3) at the time of beer pouring.

A plurality of connecting openings 52 for passing carbonic acid are formed at the outer flange 50.

A handle 56 is swingably supported at the upper portion of the housing 2 by a pin 54. The handle 56 has a pair of cylindrical projections 58 which are formed at the portion near the pin 54 and projected in the direction toward the sliding body 38, as shown in FIG. 2.

Ditches 60 are formed on the outer circumferential surface of the sliding body 38 in the horizontal direction so as to face the handle of the sliding body 38. Projections 58 are engaged with these ditches 60 thereby to slide the sliding body 38 in the vertical direction by swinging the handle 56.

The operation of the dispensing head will be explained.

Figure 6:
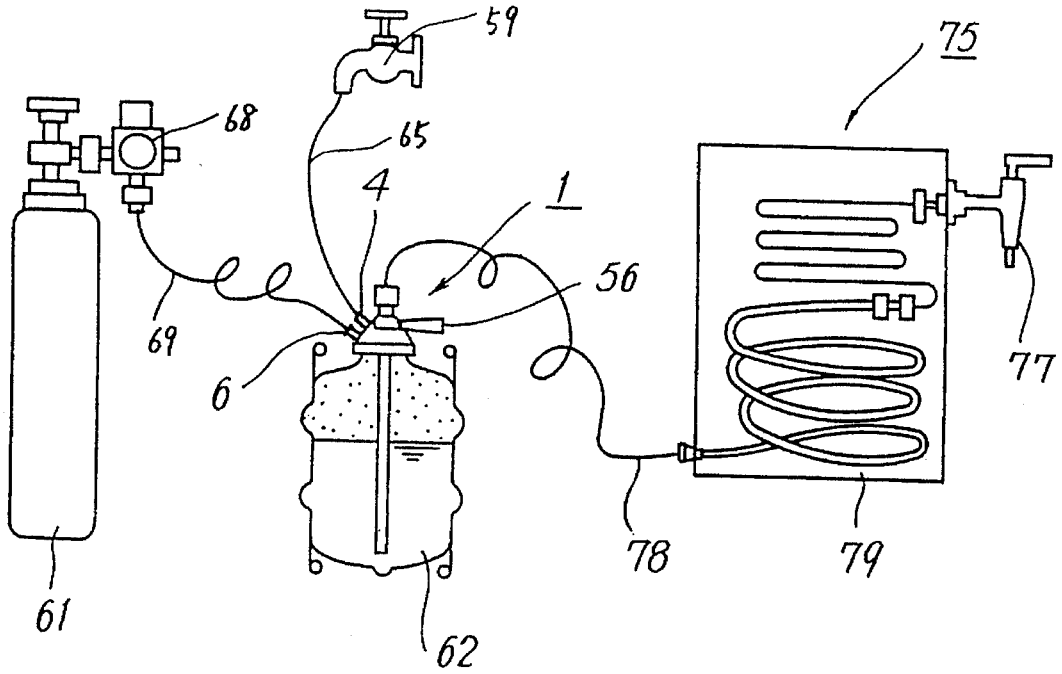
FIG. 6 is an explanatory view for explaining a flow route of washing liquid when the washing operation is done by using the dispensing head of this invention.

As shown in FIG. 6, the gas mouth 6 of the dispensing head 1 is connected to a cylinder 61 via a reducing valve 68 and a connecting tube 69, and the washing liquid mouth 4 is connected to a tap 59 via a connecting tube 65.

The operation of beer pouring will be explained.

Figure 4:
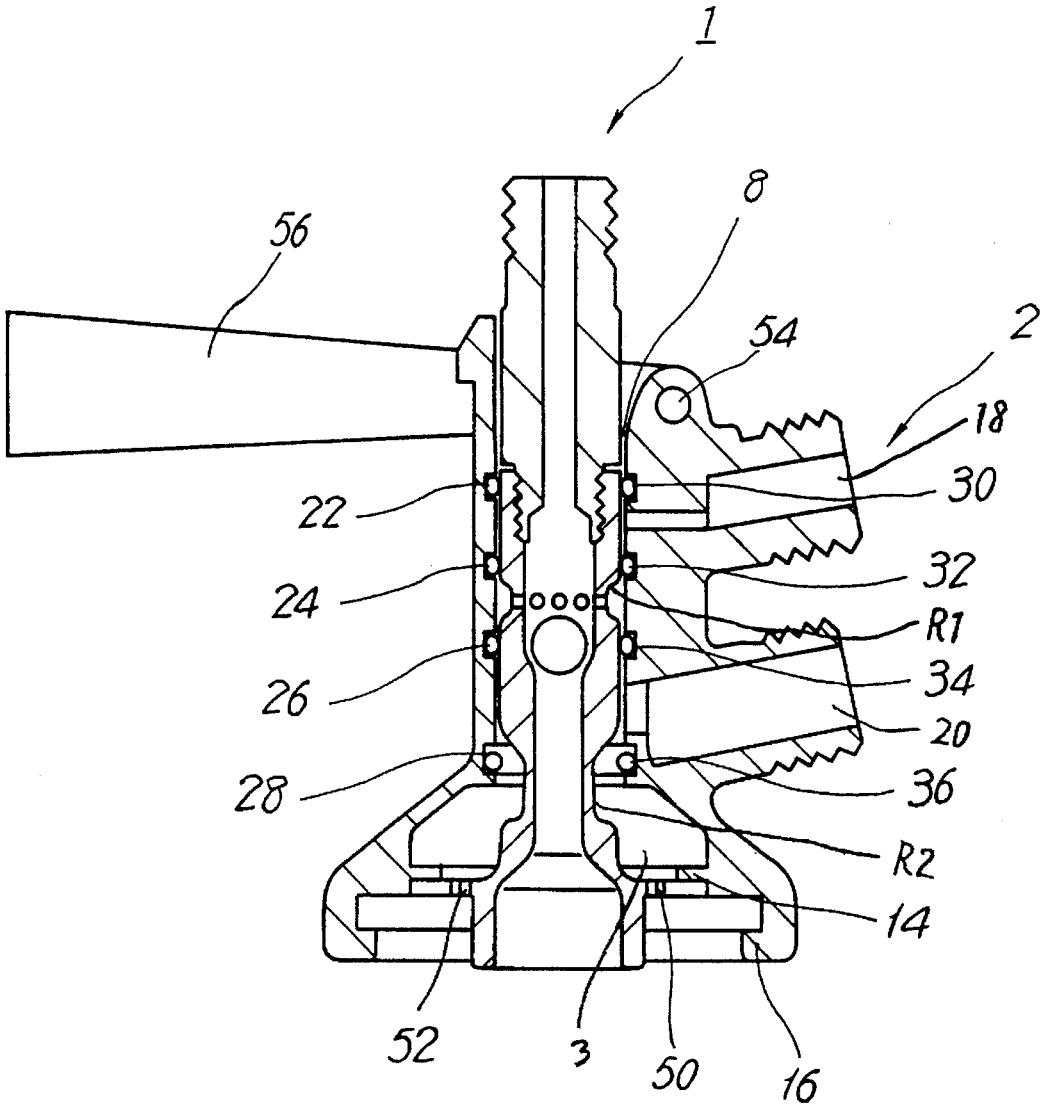
FIG. 4 is an elevational sectional view of the dispensing head of this invention at the time of pouring.

The handle 56 in the state of FIG. 1 is moved downwardly to swing it about the pin 54 (see FIG. 4).

The handle 56 slides the sliding body 38 in the downward direction since the projections 58 and the ditches 60 are connected to each other. Thereby, the recessed part R1 is positioned between the O-ring 24 and the O-ring 26, the washing liquid is stopped by the O-ring 22 and the O-ring 24, and the recessed part R2 is inserted into the expanded space 3. The O-ring 28 is separated from the outer circumferential surface of the sliding body 38 to open the carbonic acid flowing path.

Figure 5:
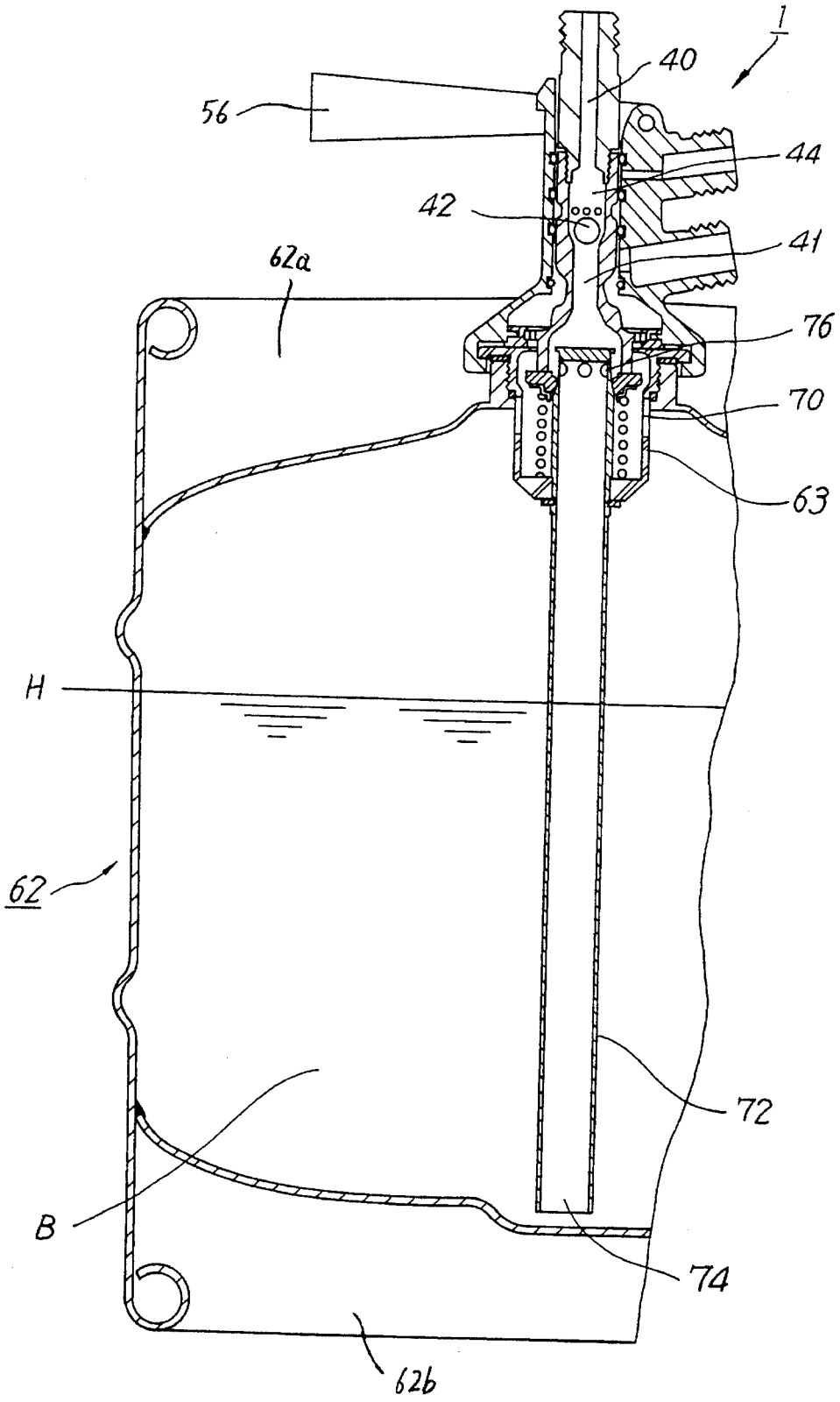
FIG. 5 is an elevational sectional view of the dispensing head of this invention, installed at a keg at the time of pouring.

The dispensing head 1 in the state wherein the carbonic acid flowing path is opened is shown in FIG. 4, the dispensing head 1 connected to the keg is shown in FIG. 5, and the enlarged view of the connecting portion of the dispensing head 1 and the keg is shown in FIG. 3.

In the state wherein the carbonic acid flowing path is opened, the packing 12 is caught between the outer flange 50 of the sliding body 38 and the upper surface of the spear valve 63 installed at the keg to prevent carbonic acid from leaking.

The contacting portion 48 of the sliding body 38 pushes the packing 64 of the spear valve 63 in the downward direction against the compressed coil spring 66 so that the packing 64 opens the space S3.

Carbonic acid gas supplied from the gas mouth 6 reaches the upper surface H of beer B (see FIG. 5) via the connecting hole 20, a plurality of connecting holes 52 formed at the outer flange 50, and a plurality of connecting openings 70 formed at the outer cylinder of the spear valve 63.

The upper surface H of the beer B is pushed in the downward direction according to the increase of the carbonic acid pressure. Thereby, the beer is poured from a pouring valve 77 via the lower end opening 74 of the discharging tube 72 of the spear valve 63, a plurality of through holes 76 formed at the upper side wall of the discharging tube 72, the enlarged space 41 of the sliding body 38, the space 44, the through hole 40, a connecting tube 78, and a cooling coil 79 disposed in a dispenser 35. The beer B lifts the ball 42 during passing through the space 44.

The operation during washing will now be explained.

The handle 56 in the state of FIG. 4 is operated in the upward direction to be swung about the pin 54. The handle 56 slides the sliding body 38 in the upward direction since the projections 58 and the ditches 60 are connected to each other. At that time, the recessed space R1 face the connecting hole 18, and the washing liquid flowing path is ensured between the O-ring 22 and the O-ring 24. The recessed space R2 is positioned between the O-ring 26 and the O-ring 28 to close the carbonic acid flowing path. The dispensing head 1 in the state wherein the carbonic acid flowing path is closed is shown in FIG. 1.

At that time, the washing liquid supplied from the washing liquid mouth 4 by opening the tap 59 of water supply is introduced to the space 44 via the connecting hole 18 of the housing 2 and a plurality of connecting holes 46 of the sliding body 38.

The ball 42 closes the lower mouth of the space 44 to introduce the washing liquid in the upward direction, and to wash the connecting tube 78, the cooling coil 79 and the pouring valve 77.

An embodiment of a washing device for a beverage pouring apparatus of this invention will be explained with reference to FIGS. 7 to 10.

Figure 7:
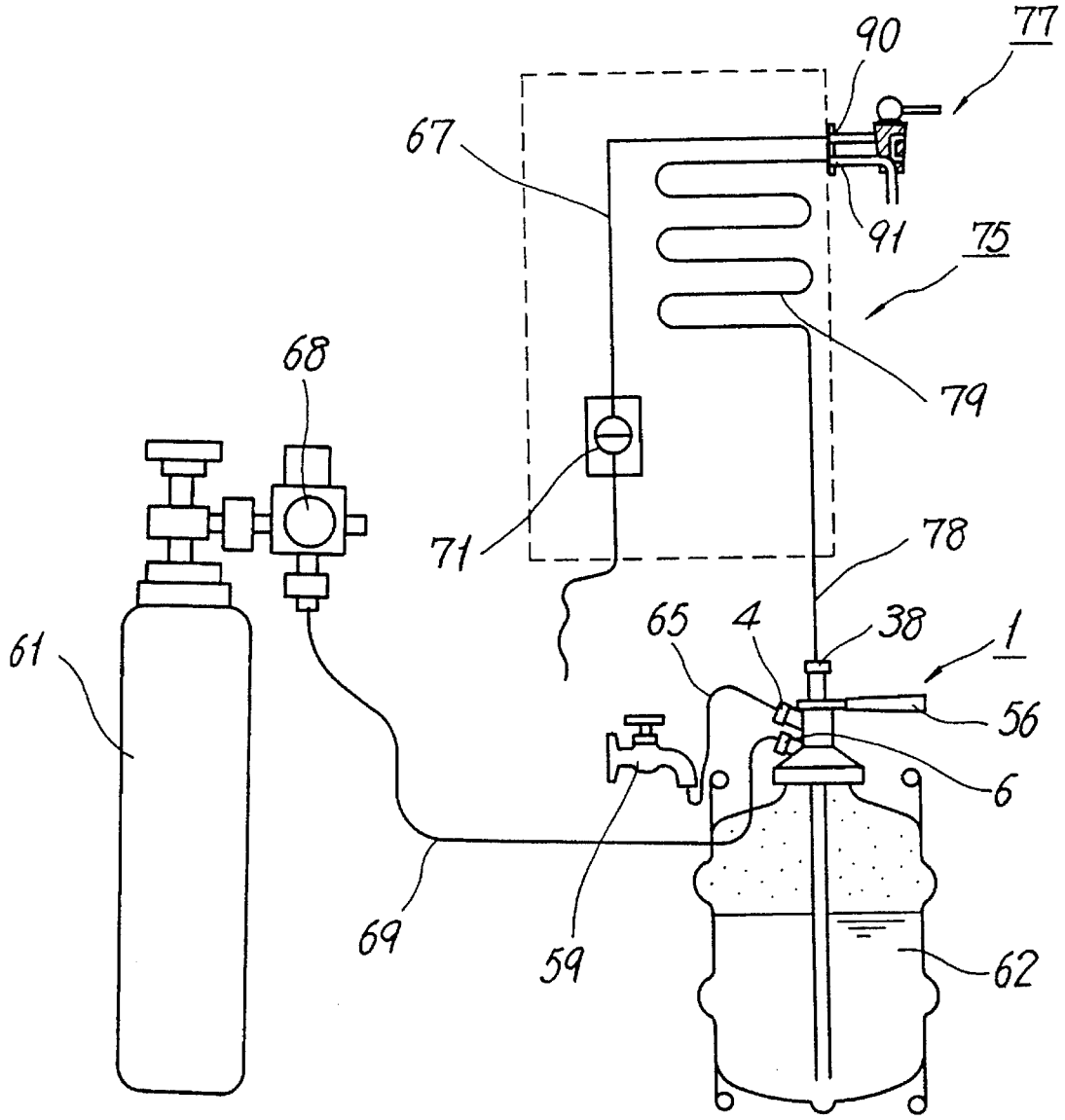
FIG. 7 is a generic arrangement view of a beverage pouring apparatus of this invention at the time of pouring.
Figure 8:
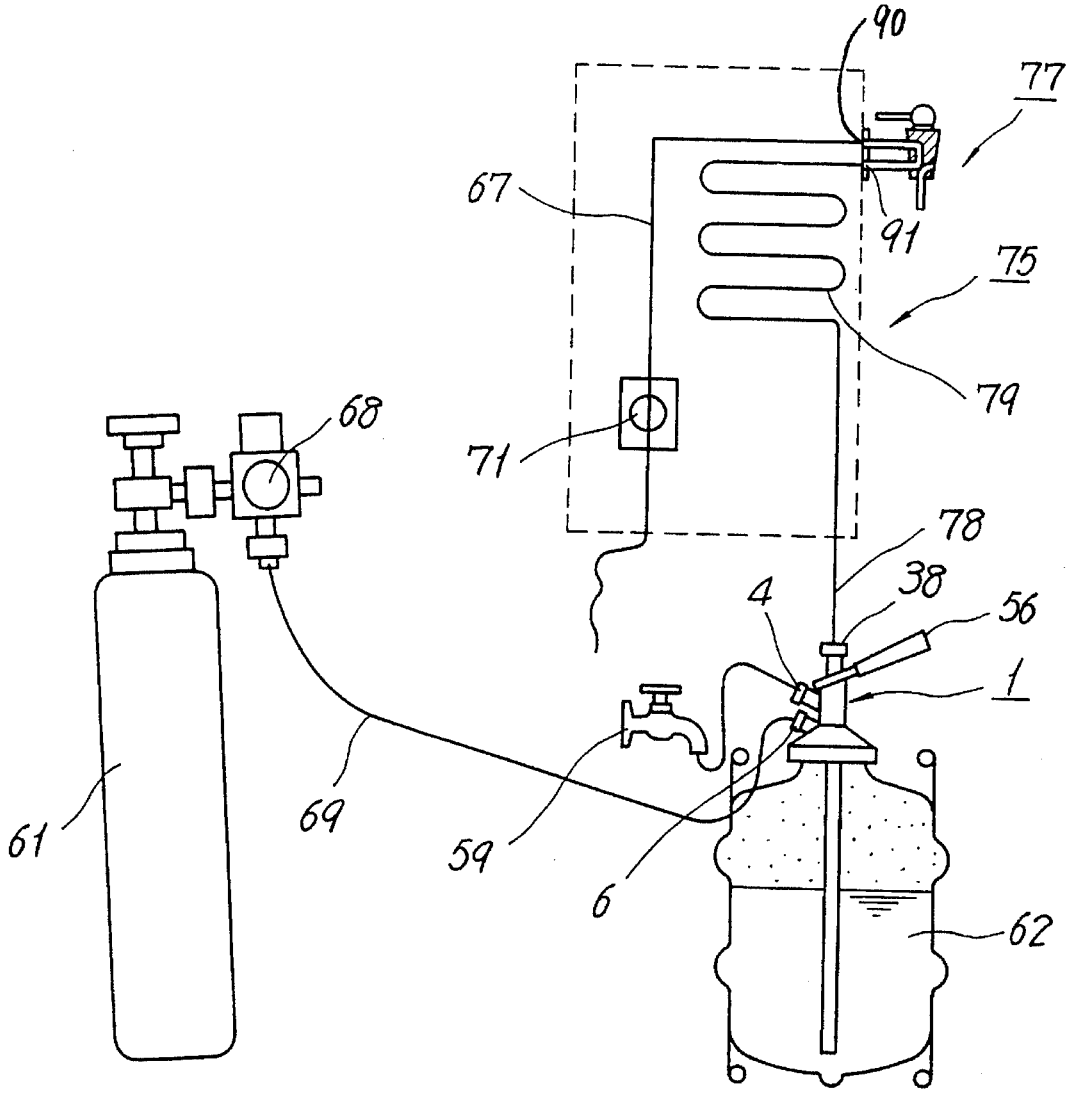
FIG. 8 is a generic arrangement view of the beverage pouring apparatus of this invention during washing.
Figure 9:
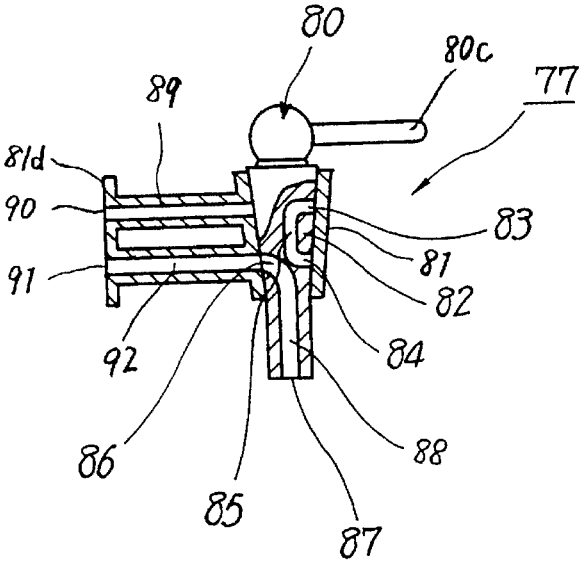
FIG. 9 is an elevational sectional view of a three way valve at the time of pouring for the beverage pouring apparatus of this invention.
Figure 10:
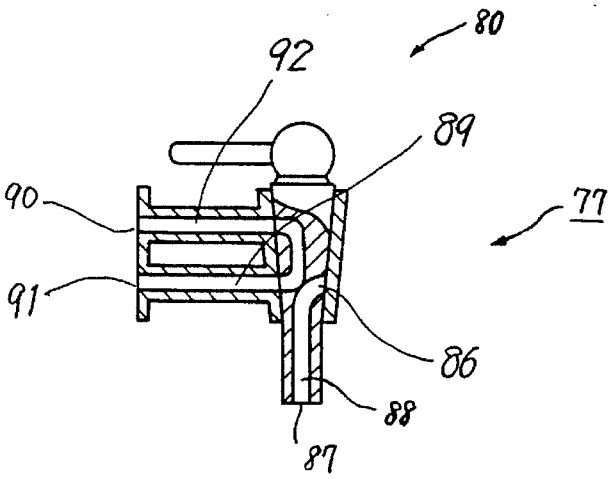
FIG. 10 is a elevational sectional view of the three way valve during washing for the beverage pouring apparatus of this invention.

FIG. 7 shows a beer pouring apparatus at the time of beer pouring, FIG. 8 shows the beer pouring apparatus during washing, FIG. 9 shows a three way valve at the time of beer pouring for the beer pouring apparatus, and FIG. 10 shows the three way valve during washing.

The three way valve 77 comprises a valve body 50 and a cylindrical valve sheet 81 (see FIG. 9). Openings 83 and 84 are formed at the side wall of the cone-shaped stopper 82 of the valve body 80 so that the openings 83 and 84 are arranged on the same vertical plane. Both openings 83 and 84 are connected by a connecting hole 85 to each other.

An opening 86 and the opening 84 are formed in symmetrical positions with respect to the center axis of the body 80. The opening 86 is connected to a beer discharging mouth 87 formed at the lower position of the stopper 82 via a connecting hole 88 passing through the center of the valve body 80. The valve sheet 81 is maintained by connecting tube 89 and 92, and the left end portion 81*d* of the connecting tubes 89 and 92 is fixed to the side wall of the dispenser 75.

During washing (in the state of FIG. 10), the connecting hole 85 connects the connecting tubes 89 and 92 which are respectively formed at the position corresponding to the openings 83 and 84.

An upper opening of the three way valve is connected to a discharging tube 67 installed inside of the dispenser 75, and a stopping valve 71 is disposed at the middle portion of the discharging tube 67.

The stopping valve 71 is for preventing beer flowing away from the discharging tube 67 when the three way valve is in the state of FIG. 10 and the handle 56 of the dispensing head 1 is lowered by accident.

Firstly, the operation at the time of beer pouring will be explained with reference to FIGS. 7 and 9.

The handle 56 of the dispensing head 1 attached to the keg 62 is lowered to close the washing liquid mouth 4 of the dispensing head 1 and to open the gas mouth 6. The beer in the keg 62 is pushed by the carbonic acid gas which is supplied from the carbonic acid gas cylinder 61 to reach the lower opening 91 of the three way valve via the upper through hole 40 of the sliding body 38 of the dispensing head 1, the connecting tube 78 and the cooling coil 39 of the dispenser 75. Since the three way valve 77 is in the state of FIG. 9, the beer is poured to a beer cup (not shown) from the beer discharging mouth 87 via the lower connecting tube 89 of the valve sheet 81 and the connecting hole 88 of the valve body 80.

Next, the operation during washing will be explained with reference to FIGS. 8 to 10.

The handle 56 of the dispensing head 1 attached to the keg 62 is lifted to open the washing liquid mouth 4 of the dispensing head 1 and to close the gas mouth 6. The water which is used for washing liquid reaches the lower opening 91 of the three way valve via the upper through hole 40 of the sliding body 38 of the dispensing head 1, the connecting tube 78 and the cooling coil 79 of the dispenser 75. Since the three way valve 77 is in the state of FIG. 10, the water is discharged out of the dispenser 75 via the lower connecting tube 89 of the valve sheet 81, the connecting hole 85 of the valve body 80, the upper connecting tube 92 of the valve sheet 81, the discharging tube 67 of the dispenser 75 and the stopping valve 71. The discharging valve 67 is connected to an outer discharging portion such as a sink so that the circumference of the dispenser 75 does not become dirty during washing.

In the above, the dispensing head in which the gas mouth and the washing liquid mouth are changed to each other is explained. However, this invention can be adaptable to a conventional dispensing head which has only a gas mouth. In case that the conventional dispensing head is used, the connecting tube 78 is taken away from the dispensing head 1 and directly connected to the tap 59 during washing.

Another embodiment of the beverage pouring apparatus will be explained with reference to FIGS. 11 to 13.

Figure 11:
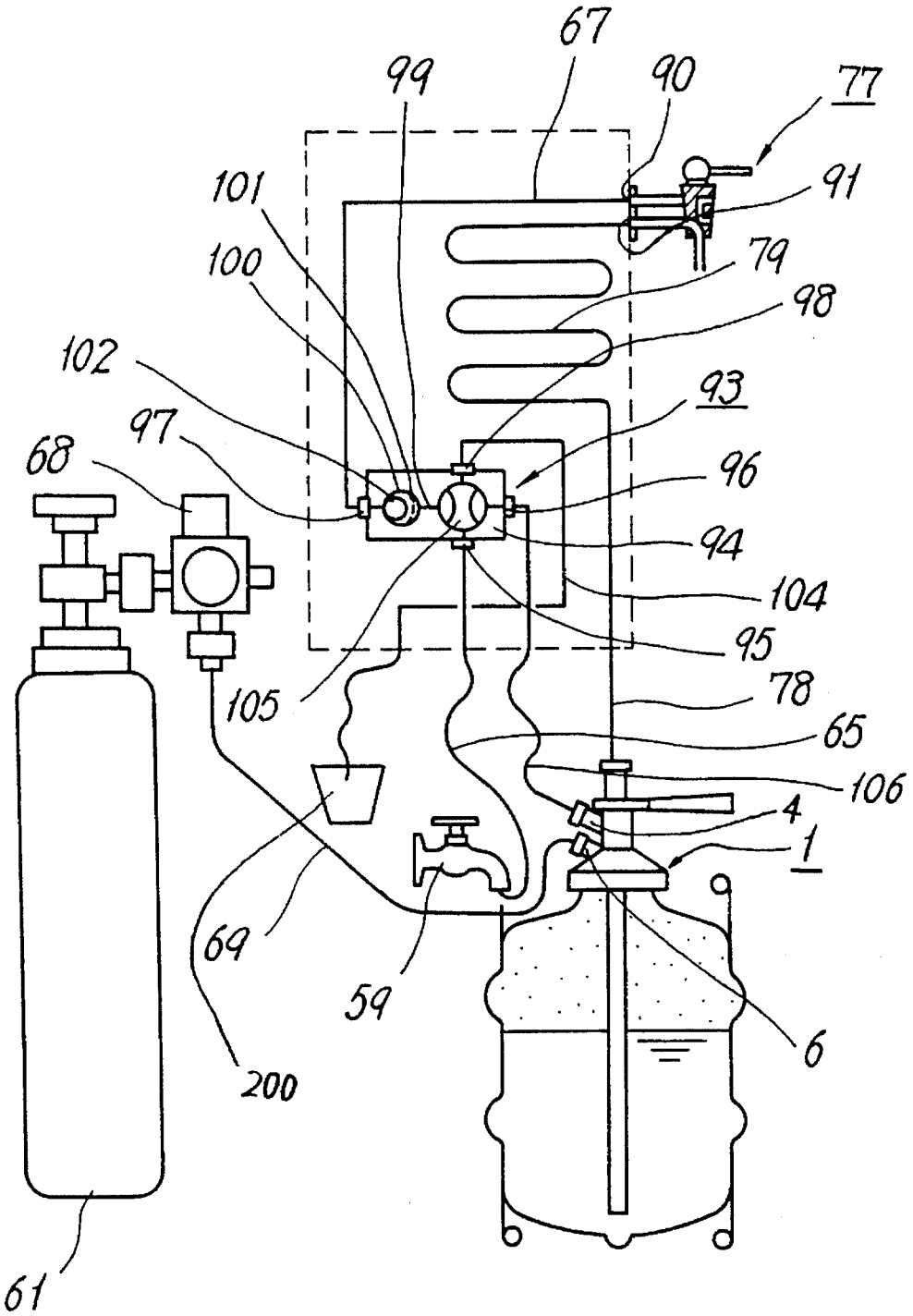
FIG. 11 is a schematic arrangement view of the beverage pouring apparatus of this invention at the time of pouring.
Figure 12:
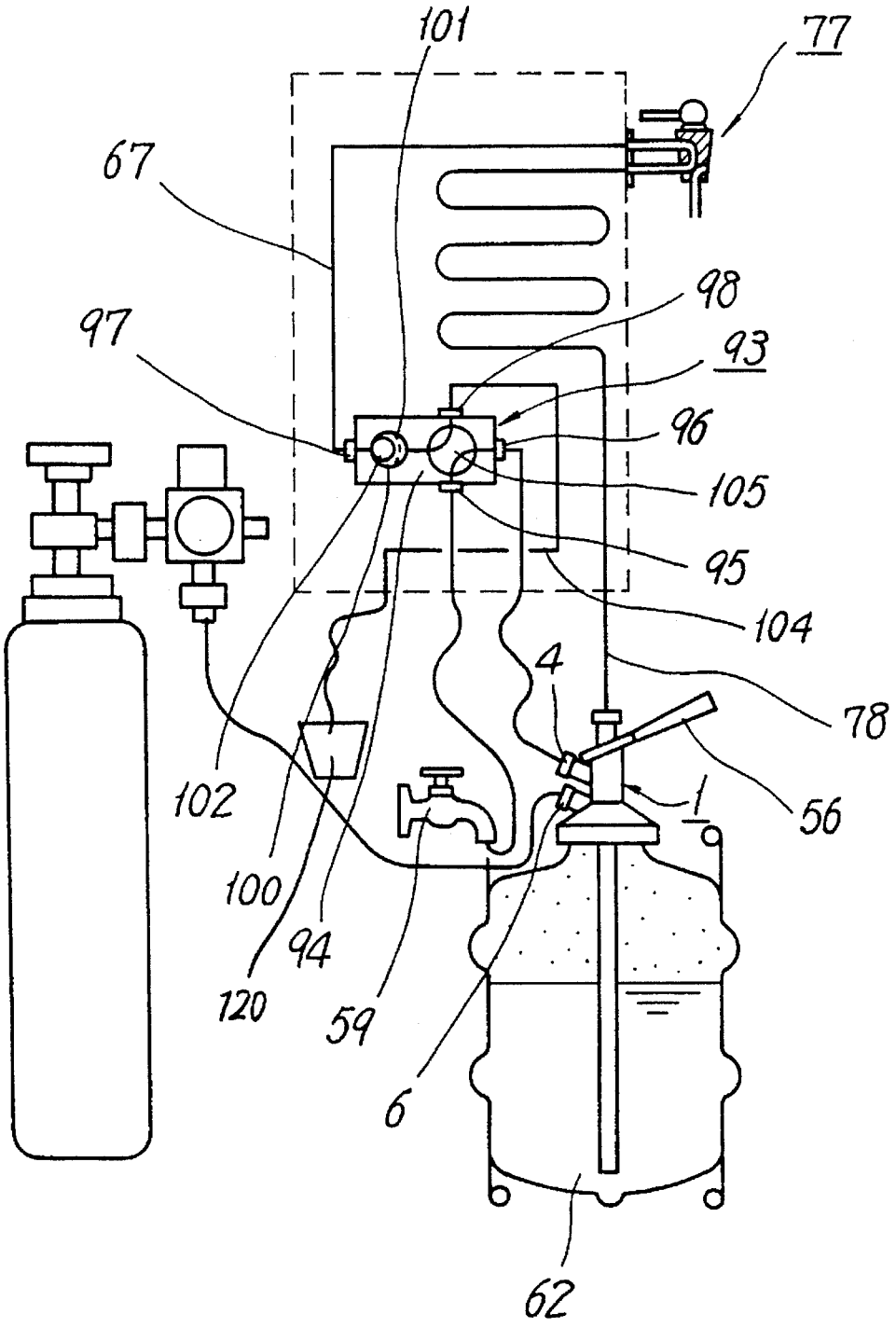
FIG. 12 is a schematic arrangement view of the beverage pouring apparatus of this invention in which washing liquid is supplied in one direction.
Figure 13:
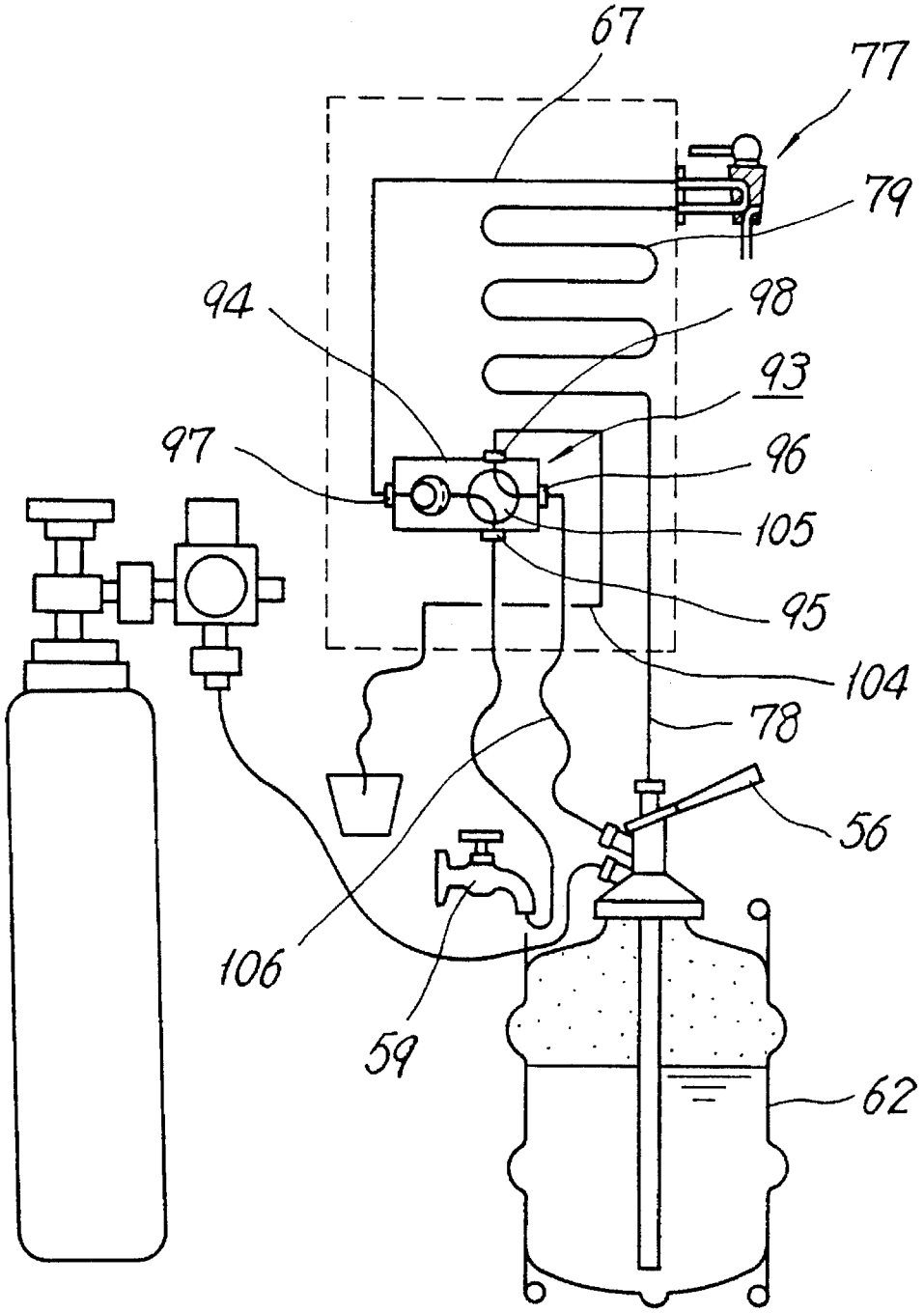
FIG. 13 is a schematic arrangement view of the beverage pouring apparatus of this invention at the time of washing in the reverse direction.
Figure 14:
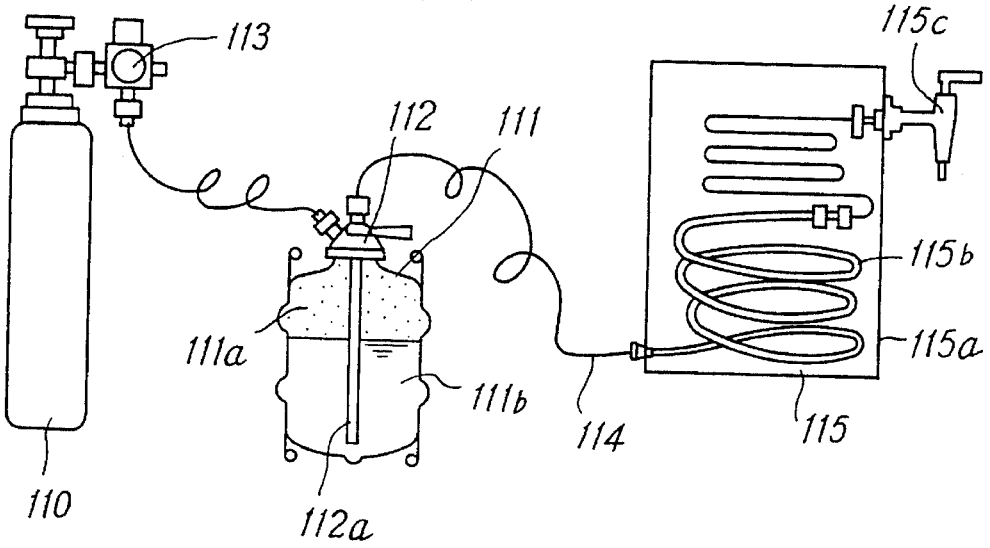
FIG. 14 PRIOR ART
FIG. 14 is a schematic arrangement view of a conventional beverage pouring apparatus at the time of pouring.
Figure 15:
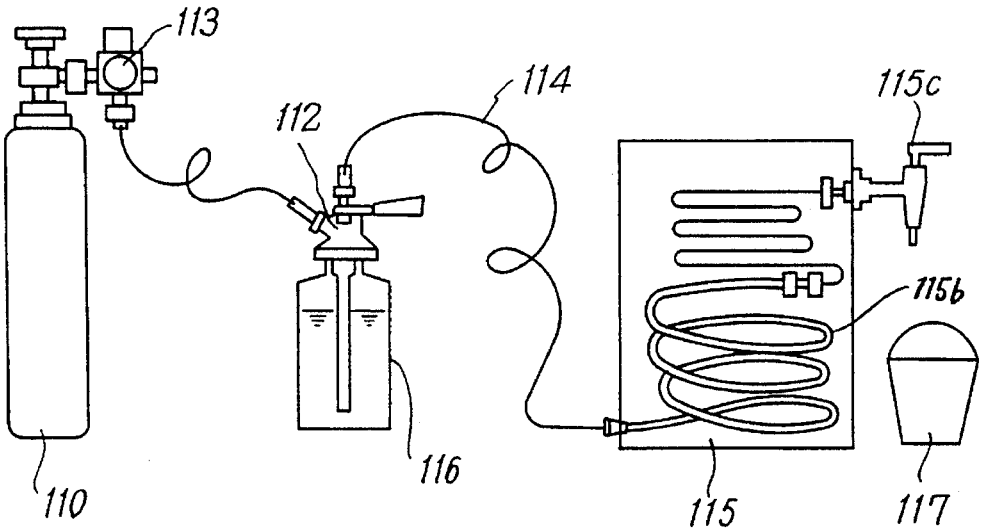
FIG. 15 PRIOR ART
FIG. 15 is a schematic arrangement view of the conventional beverage pouring apparatus during washing.

FIG. 11 shows the beer pouring apparatus at the time of beer pouring, FIG. 12 shows the beer pouring apparatus in which washing liquid is supplied in one direction, and FIG. 13 shows the beer pouring apparatus in which washing liquid is supplied in the reverse direction.

In FIG. 11, the reference numeral 93 is a known four way valve, and the housing 94 of the four way valve 93 has four connecting mouths 95, 96, 97 and 98.

The connecting portion 99 of the connecting mouth 97 of the housing 94 has a space 100, and a net 101 inserted into the space 100 for preventing a sponge ball 102 which is moved together with the flow of washing liquid from circulating to a valve body 105.

In FIG. 11, the discharging portion of the carbonic acid cylinder 61 is connected to the gas mouth 6 of the dispensing head 1 attached to the keg 62 via a reducing valve 68 attached to the discharging portion and a carbonic acid gas supplying tube 69.

The tap 59 as a washing liquid supplying apparatus is connected to the connecting mouth 95 of the four way valve 93 via the connecting tube 65. The connecting mouth 96 of the four way valve 93 is connected to the washing liquid mouth 4 of the dispensing head 1 attached to the keg 62 via a washing liquid supplying tube 106.

The upper through hole 40 of the sliding body 38 of the dispensing head 1 is connected to the cooling coil 79 of the dispenser 75 via the connecting tube 78. The discharging portion of the cooling coil 79 is connected to the lower opening 91 of the three way valve 77, and the upper opening 90 of the three way valve 77 is connected to the connecting mouth 97 of the four way valve 93 via the discharging tube 76 of the dispenser 75. The connecting mouth 98 of the four way valve 93 is connected to the outside of the dispenser 75 via a discharging tube 104 to discharge washing liquid to a discharging container 200.

The operation of the beverage pouring apparatus of another embodiment will be explained.

The beer pouring flowing path of the apparatus is shown in FIG. 11. Since the operation of the apparatus in FIG. 11 is the same as that of apparatus in FIG. 7, the explanation is omitted. However, the valve body 105 of the four way valve 93 is in neutral position, connecting mouths 95, 96, 97 and 98 are not connected to each other, and the sponge ball 102 is located in the space 100 of the housing 94.

The operation of the beer pouring apparatus of another embodiment in which washing liquid is supplied in one direction will be explained with reference to FIG. 12.

The valve body 105 of the four way valve 93 is rotated to connect the connecting mouth 95 of the housing 94 to the connecting mouth 96, and the connecting mouth 97 to the connecting mouth 98. The handle 56 of the dispensing head 1 attached to the keg 62 is lifted to open the washing liquid mouth 4 of the dispensing head 1 and to close the gas mouth 6.

Water supplied from the tap 59 for using as washing liquid reaches the lower opening 91 of the three way valve via the connecting mouth.95 of the four way valve 93, the valve body 105, the connecting mouth 96, the upper through hole 40 of the sliding body 38 of the dispensing head 1, the connecting tube 78 and the cooling coil 79 of the dispenser 75. Since the three way valve 77 is in the state of FIG. 10, the water is discharged out of the dispenser 75 via the lower connecting tube 89 of the valve sheet 81, the connecting hole 85 of the valve body 80, the upper connecting tube 92 of the valve sheet 81, the discharging tube 67 of the dispenser 75, the connecting mouth 97 of the four way valve 93, the valve body 105, the connecting mouth 95 and the discharging tube 104.

At that time, the sponge ball 102 which is in the space 100 of the housing 94 does not prevent the flowing of washing liquid, because the sponge ball 102 has a large number of holes inside thereof.

The operation of washing in one direction in the state wherein the sponge ball 102 is accommodated in the space 100 is explained above. After the washing in the reverse direction stated after, since the sponge ball 102 stays at the upper portion of the upper through hole 40 of the sliding body 38 of the dispensing head 1, the sponge ball 102 returns to the space 100 via the connecting tube 78, the cooling coil 79 of the dispenser 75, the three way valve 77, the discharging tube 67 of the dispenser 75 and the connecting mouth 97 of the four way valve 93. At that time, the sponge ball 102 stayed at the upper portion of the upper through hole 40 of the sliding body 38 of the dispensing head 1 flows along the same route under the pressure of washing liquid. The sponge ball 102 is prevented from entering inside of the valve body 105 by the net 101 accommodated in the space 100 of the housing 94. The sponge ball 102 rubs the inner wall of the connecting tube 38, etc., while the sponge ball 102 is moving. Therefore, the washing effect is increased.

In the above, the embodiment in which the apparatus has the sponge ball 102 is explained. However, this invention is not limited to the embodiment in which the apparatus has a sponge ball.

The operation of the beer pouring apparatus of another embodiment at the time of washing in the reverse direction will be explained with reference to FIG. 13.

The valve body 105 of the four way valve 93 is rotated to connect the connecting mouth 95 to the connecting mouth 97 of the housing 94, and the connecting mouth 98 to the connecting mouth 96. The positions of the handle 56 of the dispensing head 1 attached to the keg 62 and the pouring valve 77 are the same as when washing liquid is supplied in one direction.

Water supplied from the tap 59 for using as washing liquid is discharged out of the dispenser 75 via the connecting mouth 95 of the four way valve 93, the valve body 105, the connecting mouth 97, the discharging tube 67, the three way pouring valve 77, the cooling coil 79 of the dispenser 75, the connecting tube 78, the upper through hole 40 of the sliding body 38 of the dispensing head 1, the washing liquid supplying tube 106, the connecting mouth 96 of the four way valve 93, the valve body 105, the connecting mouth 98 and the discharging tube 104.

The operation of washing in one direction and the operation of washing in the reverse direction are alternately repeated.

The apparatus of this invention is capable of flowing washing liquid at a high speed by only changing the three way valve. Therefore, the washing effect is increased. The change of the flowing of washing liquid in both directions can be performed easily by only changing the four way valve without the troublesome changing of the dispensing head. Further, in case that he sponge ball is inserted into the flowing path of washing liquid, the washing effect is further increased. Because the sponge ball rubs the inside wall of the flowing route of washing liquid.

INDUSTRIAL APPLICABILITY

A dispensing head and a washing apparatus for a beverage pouring apparatus are most suitable for treading beverage containing carbonic acid gas, especially beer. Further, these inventions are applicable for another beverage pouring system, for example, cola or soda pop, etc.

I claim:

1. A washing apparatus for a beverage pouring apparatus which supplies washing liquid to the beverage pouring apparatus for pouring beverage cooled during passing through a cooling coil from a pouring valve to wash the inside of the beverage pouring apparatus, wherein a washing liquid discharging tube for discharging washing liquid supplied to the beverage pouring apparatus is provided, and, the pouring valve is a three way valve which has a first mouth to be connected to the cooling coil, a second mouth to be connected to the washing liquid discharging tube and a third mouth for pouring beverage to be positioned at three positions, that is, a position where the first mouth and the second mouth are connected to each other, a position where the first mouth and the third mouth are connected to each other and a position where each mouth is not connected to each other.

2. The washing apparatus for a beverage pouring apparatus according to claim 1 wherein a stopping valve for opening and closing the washing liquid discharging tube is connected at a middle portion of the washing liquid discharging tube.

3. A washing apparatus for a beverage pouring apparatus which supplies washing liquid to the beverage pouring apparatus for cooling beverage pushed out from a container under pressure of carbonic acid gas supplied to the container via a dispensing head and for pouring beverage from a pouring valve to wash the inside of the beverage pouring apparatus, wherein the dispensing head comprises a washing liquid mouth to be connected to a supplying source of the washing liquid, and supplies the washing liquid introduced from the washing liquid mouth to the cooling coil by operating the dispensing head;

the washing apparatus comprises a washing liquid discharging tube for discharging the washing liquid passed through the beverage pouring apparatus;

the pouring valve is a three way valve which has a first mouth to be connected to the cooling coil, a second mouth to be connected to the washing liquid discharging tube and a third mouth for pouring beverage to be positioned at three positions, that is, a position where the first mouth and the second mouth are connected to each other, a position where the first mouth and the third mouth are connected to each other and a position where each mouth is not connected to each other;

the washing apparatus further comprises a four way valve which has a fourth mouth to be connected to a supplying source of the washing liquid, a fifth mouth to be connected to a washing liquid mouth of the dispensing head, a sixth mouth to be connected to the washing liquid discharging tube and a seventh mouth to be connected to a washing liquid discharging portion to be positioned at three positions, that is, a position where the fourth mouth is connected to the fifth mouth and the sixth mouth is connected to the seventh mouth, a position where the fourth mouth is connected to the sixth mouth and the fifth mouth is connected to the seventh mouth, and a position where each mouth is not connected to each other.

4. The washing apparatus for a beverage pouring apparatus according to claim 3, wherein a ball is movably inserted into a flowing path of the washing liquid which is formed of the cooling coil and the washing liquid discharging tube between the dispensing head and the four way valve when the three way valve is located at the position where the first mouth and the second mouth are connected to each other.

* * * * *